United States Patent [19]

Nicholas et al.

[11] Patent Number: 4,614,011

[45] Date of Patent: Sep. 30, 1986

[54] WEB STRETCHING APPARATUS

[75] Inventors: Donald C. Nicholas, Manningtree; Gordon C. R. Smith, Colchester, both of England

[73] Assignee: BXL Plastics Limited, United Kingdom

[21] Appl. No.: 801,400

[22] Filed: Nov. 26, 1985

Related U.S. Application Data

[63] Continuation of Ser. No. 751,810, Jul. 5, 1985, abandoned, which is a continuation of Ser. No. 679,388, Dec. 7, 1984, abandoned, which is a continuation of Ser. No. 558,355, Dec. 5, 1983, abandoned, which is a continuation of Ser. No. 490,474, May 2, 1983, abandoned, which is a continuation of Ser. No. 286,844, Jul. 27, 1981, abandoned, which is a continuation of Ser. No. 101,445, Dec. 10, 1979, abandoned, which is a continuation of Ser. No. 21,313, Mar. 16, 1979, abandoned, which is a continuation of Ser. No. 908,370, May 22, 1978, abandoned, which is a continuation of Ser. No. 822,815, Aug. 8, 1977, abandoned, which is a continuation of Ser. No. 559,587, Mar. 18, 1975, abandoned, which is a continuation of Ser. No. 369,609, Jun. 13, 1973, abandoned.

[51] Int. Cl.[4] ..... D06C 3/04

[52] U.S. Cl. ..... 26/73; 26/93

[58] Field of Search ..... 26/73, 93; 264/290.2

[56] References Cited

U.S. PATENT DOCUMENTS

| | | | |
|---|---|---|---|
| 3,123,854 | 3/1964 | Aykanian | 26/73 |
| 3,148,409 | 9/1964 | Bruckner | 26/73 |
| 3,153,812 | 10/1964 | Sakakibara et al. | 26/73 |
| 3,195,177 | 7/1965 | Kawamura et al. | 26/73 |
| 3,256,558 | 6/1966 | Andersen et al. | 26/73 |
| 3,276,071 | 10/1966 | Nagae et al. | 26/73 |
| 3,469,291 | 9/1969 | Gageur | 26/93 |
| 3,500,515 | 3/1970 | Cunningham et al. | 26/93 |

FOREIGN PATENT DOCUMENTS

| | | | |
|---|---|---|---|
| 1004563 | 9/1965 | United Kingdom | 26/73 |

*Primary Examiner*—Robert R. Mackey

*Attorney, Agent, or Firm*—Millen & White

[57] ABSTRACT

Web-stretching apparatus wherein the web, gripped by web-gripping devices mounted to carriages which run on guide rails, is stretched by increasing the distance between adjacent gripping devices by altering the degree of extension of an articulated chain to which the carriages are attached.

5 Claims, 10 Drawing Figures

I
I
II
III
IV
V
1
2
3
4
5
8
9
10
13
14
16
18
21

A
B
C
D
E
F
G
H
I
J
K
L
M
N
O
P
Q
R
10

WEB STRETCHING APPARATUS

RELATED PATENT APPLICATIONS

This application is a continuation of Ser. No. 06/751,810 of 07/05/85 which is a continuation of Ser. No. 06/679,388 of 12/07/84 which is a continuation of Ser. No. 06/558,355 of 12/05/83, which is a continuation of Ser. No. 06/490,474 of 05/02/83, which is a continuation of Ser. No. 06/286,844 of 07/27/81, which is a continuation of Ser. No. 06/101,445 of 12/10/79, which is a continuation of Ser. No. 06/021,313 of 03/16/79, which is a continuation of Ser. No. 05/908,370 of 05/22/78, which is a continuation of Ser. No. 05/822,815 of 08/08/77, which is a continuation of Ser. No. 05/559,587 of 03/18/75, which is a continuation of Ser. No. 05/369,609 of 06/13/73, all of which have been abandoned.

BACKGROUND OF THE INVENTION (1) Field of the Invention

This invention relates to apparatus for stretching a moving web of material, and relates particularly but not exclusively to apparatus for stretching a moving web of plastic material, for example polyethylene and polypropylene.

(2) Prior Art and Technical Considerations

It is well known that certain plastic material webs can acquire improved physical properties by stretching either when the web is hot or when it is cold. It is also known that while such stretching is carried out, it is preferable that the web should be under physical control.

Various apparatuses for stretching webs in a controlled manner have been described. Of these, there is a type of apparatus which employs articulated chains. For example, there is described in British Patent Specification No. 936,965 such an apparatus which comprises two endless articulated chains each of which is driven and guided along a predetermined path, the chains being caused to expand as they travel along their working runs which extend on either side of the path of the web of material. A number of web gripping devices are connected at intervals to each chain and these, in operation, grip the edges of the web such that a pulling action in the axial and/or transverse direction is transmitted to the web. Longitudinal stretching of the web is achieved by expanding the chain thereby increasing the distance between adjacent gripping devices. Transverse stretching is achieved by arranging that over part at least of the working runs of the chains, the chains diverge with respect to the web.

British Patent Specifiction No. 1,091,971 describes a similar apparatus to that described in British Patent Specification No. 936,965 in which means are provided whereby a adjustments may be made to the stretch ratios in the longitudinal and transverse directions of a web while the apparatus is in operation.

In such apparatuses, the expansion and contraction of the chains and the paths of the folded chains are controlled by guiding each link at two points spaced thereon, each guide member associated with each of said points being in substantially constant engagement with guide means. In consequence, even when a chain is not being subjected to controlled expansion or contraction, the guide members in engagement with guide means, such as a track, are contributing to the total frictional drag on the movement of a chain. In addition, the bearings associated with the guide members are suffering undue wear. However, web stretching apparatuses based on the articulated chain principle have a number of advantages over other types. One particular feature is that in expanding the chain by a simple means, such as described in British Patent Specifications Nos. 936,965 and 1,091,971, the rate of expansion is automatically progressively reduced. This can be a desirable feature of an apparatus for use in the stretching of webs of plastic materials. Accordingly, this type of apparatus is of considerable importance and it is therefore desirable to obtain a high degree of efficiency for such apparatus. Towards this end, it is highly desirable to reduce the frictional drag and wear. In addition, it is also desirable to reduce to a minimum the proportion of the path of the chain in which the chain is in the folded state and especially in the almost completely folded state, while each of the guide members is in engagement with guide means, in which state of the chain the toggle action which may be set up when the chain is subjected to a compression force, and which may result in unsmooth running of the apparatus, may have its greatest effect. This toggle action may result particularly from a build-up friction arising between the guide members and the guide means tending to retard the progress of the chain in response to a compression force applied to the chain in the intended direction of motion of the chain. The normal running friction arising between the guide members or attachments thereto and the guide means may be undesirably increased through any tendency for the guide members or attachments thereto to become distorted or misaligned relative to guide means contacted thereby. As a result, it has been found to be of paramount importance to reduce to a low level the friction between the guide members or the attachments thereto and the guide means and to limit the possible distortion or misalignment, whether temporary or permanent, of the guide members relative to the guide means.

SUMMARY OF THE INVENTION

According to the present invention, there is provided apparatus for stretching a moving web of material, which apparatus comprises two endless articulated chains, positioned to run along opposite sides of a moving web to be stretched, a plurality of web-gripping devices mounted at intervals along the length of each chain, primary and secondary guide means for each chain for guiding the chain along a closed path in such a way that the degree of folding of the links of the chain can be varied at different points along the path so varying the distance between adjacent gripping devices, primary and secondary guide members attached to each link of each chain and arranged to engage the primary and secondary guide means, respectively, and means for causing the web gripping devices to grip and hold the web at a desired point along the path of each chain and to release the web at a second desired point along the path of each chain characterized in that each primary guide member is a wheeled carriage arranged to ride on the primary guide means in such a way that each carriage can move along its associated primary guide means with its wheels in rolling contact therewith while being substantially restrained by the reaction between the wheels and the primary guide means against rotation about three mutually perpendicular axes.

The primary guide means, which is preferably continuous, may be, for example, any track, groove or channel along which the wheeled carriages can move while being restrained, by the reaction between the wheels and the guide means, against rotation about three mutually perpendicular axes.

BRIEF DESCRIPTION OF THE DRAWINGS

Apparatus in accordance with the present invention will now be described by way of example only with reference to the drawings in which only one half of the apparatus is shown, the other half being a mirror image thereof.

DESCRIPTION OF THE PREFERRED EMBODIMENTS

Figure 1:
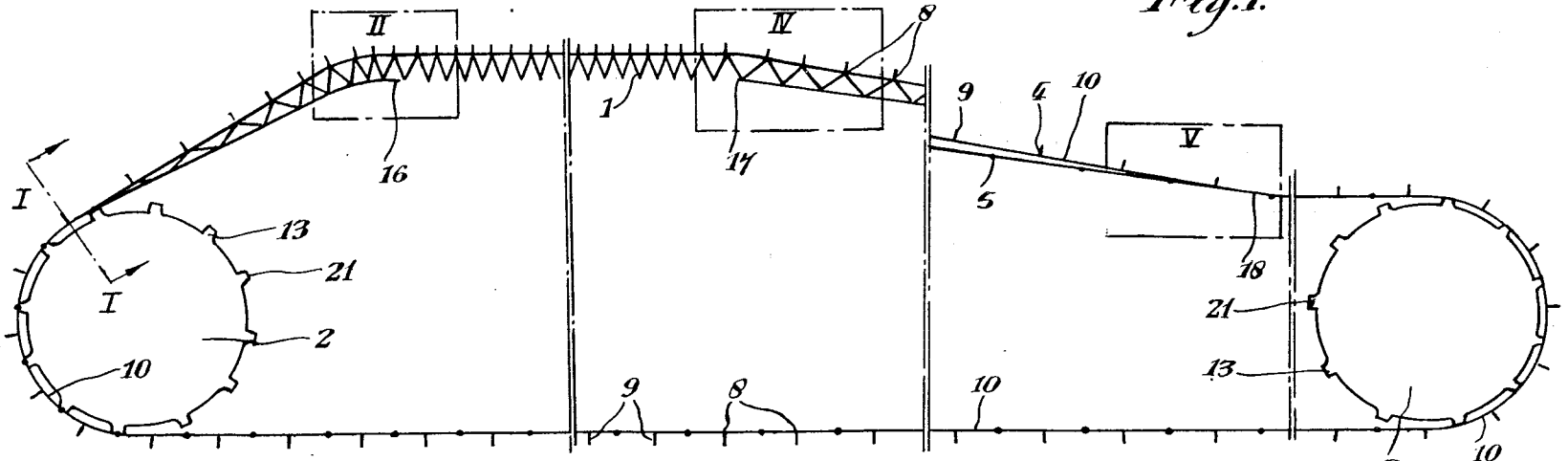
FIG. 1, shows a general layout for one form of apparatus according to the present invention.

According to the present invention, there is provided apparatus for stretching a moving web of material, which apparatus comprises two endless articulated chains, positioned to run along opposite sides of a moving web to be stretched, a plurality of web-gripping devices mounted at intervals along the length of each chain, primary and secondary guide means for each chain for guiding the chain along a closed path in such a way that the degree of folding of the links of the chain can be varied at different points along the path so varying the distance between adjacent gripping devices, primary and secondary guide members attached to each link of each chain and arranged to engage the primary and secondary guide means, respectively, and means for causing the web gripping devices to grip and hold the web at a desired point along the path of each chain and to release the web at a second desired point along the path of each chain characterized in that each primary guide member is a wheeled carriage arranged to ride on the primary guide means in such a way that each carriage can move along its associated primary guide means with its wheels in rolling contact therewith while being substantially restrained by the reaction between the wheels and the primary guide means against rotation about three mutually perpendicular axes.

Preferably, however each primary guide means is an endless rail along which can ride a plurality of wheeled carriages, each carriage having at least three wheels and and the rail at least three running surfaces, at least two of the wheels being arranged to run on first and second running surfaces of the rail that are on opposite sides of and are non-perpendicular to, a plane passing through the rail in the direction of the movement of the chain and perpendicular to the plane of stretching, and that are inclined at an angle of less than 90°, advantageously 10–80°, preferably about 45° to one another.

Of these two running surfaces, the first is preferably substantially perpendicular to the plane of stretching and is preferably on the inside of the closed path formed by the rail.

Although the third running surface may be inclined at an obtuse angle to the first surface, advantageously the angle is less than 90° and is preferably 10°–80° and especially about 45° to the first surface. Further, the third surface is preferably inclined at an angle of 160°–20° especially about 90° to the second surface.

While it is preferable that the running surfaces of the rail are flat, it should be appreciated that at least one of the surfaces may be curved, in which case the angle between the surfaces is determined using the plane containing the tangent drawn at the point where the wheel of the carriage contacts the curved surface.

The use of running surfaces that are in plane that are not parallel to the general plane of the apparatus results in a reduction in frictional drag and scuffing imposed on the carriages as they negotiate bends in the rail. As the inclination of the surfaces to the plane of stretching increases towards 90°, a greater reduction results but when the angles are very small or very large the risk of the carriage jamming on the rail, for example by an applied rotational force is increased, and, therefore, angles in the range of 10°–80° are preferable, and an angle of about 45° is especially preferred.

In the case in which two running surfaces on the outside of the closed path formed by the rail are at an angle of 45° to the general plane of the apparatus, the frictional drag on the carriages as they negotiate bends is reduced to an acceptable level consistent with a reasonable support for the carriages while keeping the number of running surfaces on the rail to a minimum.

Preferably, the general plane of the apparatus is substantially horizontal, and it will be seen that in this case that each carriage may be adequately supported by two wheels, the axes of which are inclined at an angle of 45° to one another, on the running surfaces of the rail which are also inclined at 45° to one another.

Carriages employed in the apparatus of this invention may be of any desired shape consistent with the requirement that they should be able to ride on the guide means while being substantially restrained from rotation about three mutually perpendicular axes. Carriages are preferably "C"-shaped and are preferably attached to the pivotal connection between two links of the chain.

In an apparatus of this type it is necessary, to allow free running of the apparatus, to provide a working clearance between the wheels of each carriage and the primary guide means on which it runs. Such clearance also allows for imperfections in the primary guide means. Because of this, some degree of rotational freedom of each carriage must be permitted. If this movement is too great, however, any over-turning force applied to the carriage could, by the time all clearances are taken up, cause the wheels of the carriage to become seriously misaligned with the result that a substantial increase in friction may occur. The apparatus is therefore desirably so designed that for a given working clearance, the degree of rotational movement of the carriage is minimized. For a given working clearance, the greater the distance between the points of contact of the wheels on the primary guide means, the smaller the degree of rotational freedom. Because practical limits have to be observed, however, it may be desirable to add further wheels to the carriage to enhance its stability. Thus, for example, one or more of the wheels may be replaced by a pair of similarly oriented wheels spaced along the line of running contact with the primary guide means. It is possible to achieve good carriage stability with only three wheels, one or more of which may be each replaced by a pair of wheels, running on three rail surfaces, but the position of the running surfaces is not so critical if a fourth wheel or pair of wheels arranged to run on a fourth running surface is provided. The running surface for the fourth wheel may be provided on a face of the rail which carries the running surface for one of the other wheels and is preferably on the face of the rail that provides the running surface for the first wheel. The provision of a fourth wheel may serve to re-distribute the force applied to the carriage and thus to reduce the risk of the carriage becoming jammed on the rail and of excessive force being applied to any given wheel.

It will be appreciated that the rotational freedom of the carriages may be further restrained by their being inter-connected through pivotally connected chain links. Accordingly, it is preferable that the carriages are pivotally secured to the chain as rigidly as possible and the working clearance of all pivotal connections are kept to a minimum. It is desirable that the pivotal connections are plain bearings.

Preferably, the working clearances of the carriages are adjustable. In the simplest arrangement, one wheel of each carriage is adjustable in such a way that adjustment of the one wheel controls the clearance of the remaining wheels of the carriage on the primary guide means. This form of adjustment is especially simplified when one of the running surfaces is inclined at an angle of about 45° to one of the other running surfaces and may be achieved by mounting one wheel on an axis which is eccentrically mounted on an adjustable rotatable pin which is lockable in the carriage by means, for example, of a grub screw. The wheels of the carriages are preferably of a type which will contribute as little friction to the apparatus as possible. It is preferable that the wheels should run with roller or ball bearings rather than plain bearings, and advantageously the wheels themselves are ball or roller races.

The articulated chains employed in the apparatus of this invention may each be any chain, the adjacent links of which are pivotally connected to one another. The links may be of the kind having spacer members between link members to enable the teeth of a driving wheel to engage between the link members, but preferably, the articulated chain has extensions on the pivotal axes of the links to provide means for engaging driving and guide means for said chain.

The drive means for each of the endless articulated chains may be derived from a moving web being pulled through the apparatus or provided through one or more sprockets around which the said chain passes or by some other means, for example, a driven auxiliary toothed chain, the teeth of which are able to engage the articulated chain or attachments thereto in driving manner. It may be desirable to use two or more drive means simultaneously. Thus, for example, if drive is desired from a web being pulled through the apparatus, it may be desirable, especially for start up purposes also to provide an independent synchronous drive for the chains. A sprocket drive arrangement is preferred and preferably two sprockets, one at each end of the apparatus are provided for each articulated chain. The two sprockets will hereinafter be referred to as a "lead-in" sprocket and a "lead-out" sprocket for each chain indicating that they lead in towards and away from the forward run, respectively. Each of the sprockets may be driven by suitable means, for example by an electric motor through gears, and preferably all the sprockets are driven by the same means thereby facilitating synchronization of moving components of the apparatus.

Each of the sprockets preferably comprises a central boss which includes the driving shaft and an adjustable peripheral portion which carries the teeth which engage the articulated chain. Preferably, the peripheral portion may be rotated about its driving shaft for adjustment and may then be locked, or clamped, in relation to the driving shaft. Adjustability of the sprockets facilitates the lining-up of the web-gripping devices in the working run on each side of the apparatus and also facilitates the taking-up of the slack in the articulated chain where this occurs. It will be appreciated that whatever the driving means, a degree of adjustability is desirable. If auxiliary toothed chains are employed, these may themselves be driven by adjustable sprockets as described.

By providing driving means for each articulated chain at two points, one at each end of the apparatus or, indeed, at the lead in end only, control of the expansion of the chains and/or the maintenance of the chains in the expanded state at each end of the apparatus may be made easier and it is not essential for the secondary guide means to be engaged by the secondary guide members along sections of the path of each chain along which the chain is already in the fully expanded state or indeed along which the chain may be allowed to expand in relatively unrestrained manner. It is preferred that each articulated chain is in the fully expanded state prior to entering the lead-in and lead-out sprockets and in this way the design of the sprockets may be simplified, fewer teeth for engaging the chain being necessary per unit length of periphery of each sprocket. In addition, the passage of each articulated chain around the relatively sharp curves at the ends of the apparatus is facilitated. It is also preferred that, in apparatus not providing for adjustability of the stretch ratios by providing for a bank of folded links in the return path, each articulated chain is in the substantially fully expanded state along its return path between the lead-out and lead-in sprockets, clearly obviating the need for the engagement of secondary guiding means along the return path, but it should be appreciated that, in apparatus incorporating a large number of links, the cumulative effect of the tolerances and/or wear occurring between links often makes it desirable for one or more link-pairs to be at least partially folded along the return path. A simple cam device can be employed to initiate folds which may then adjust themselves as the dimensions of the apparatus dictate. When the chain is allowed to fold along the return run, it is preferred to provide means at the end of the return run to cause the chain to be extended at least to a degree such that the drive can be transmitted to it smoothly. Thus a slight retarding force applied to the chain prior to its engagement with drive means will cause the drive means to extend the chain automatically. Preferably, however, a simple cam-plate, for example, may be arranged at the end of the return run to align the chain suitably for engagement by the drive means. In apparatus providing for adjustability of the longitudinal and/or transverse stretch ratio and involving a change in the number of links in the forward run, it can be advantageous to have a bank of folded links in the return run which can be drawn upon or added to, as desired, to facilitate a change in the number of links in the forward run while, for example, avoiding the necessity for parting and adding or removing links in the chain. It will be appreciated that the freedom of folding on the return run is, of course dependent upon having driving means at each end of the apparatus, which may include drive means derived from a web being pulled through the apparatus, and particularly that this freedom is acceptable only as a result of being able to dispose with the secondary guide means over this region due to the use of a stable arrangement comprising primary guide members in combination with primary guide means. In fact, it will be seen that in general with such a system, a secondary guide means is only essential where the folding or un-folding of the chain is required to be fully controlled. As will be described hereinafter, the secondary guide means may be omitted in the working run of the apparatus where the chain is in the fully folded and/or fully extended condition.

It is preferred that at least the lead-in sprocket for each articulated chain engages the chain only at alternate pivotal connections of the links or associated points on the chain, each of said connections preferably being associated in turn with one secondary guide member for each link. By driving the lead-in sprocket, the folding of each articulated chain is facilitated after passage therearound once the chain meets with resistance to forward motion and each pair of adjacent links has received an initial fold.

The secondary guide means may be, for example, any track or groove, adapted to engage and guide a secondary guide member and preferably such that it may engage, guide and disengage a secondary guide member intermittently. The secondary guide means comprise one or more sections and/or may be continuous or discontinuous. When it is continuous, intermittent engagement with secondary guide members may be arranged by causing the secondary guide members to retract from the secondary guide means or by arranging for the secondary guide means to withdraw from the secondary guide members. However, it is preferred that the secondary guide means is discontinuous which simplifies the intermittent engagement and disengagement of the secondary guide member. Preferably, the secondary guide means comprises a discontinuous channel-shaped track.

The secondary guide members of each link may merely comprise extensions of the pins comprising the pivotal connections of the ends of the chain links or may comprise members attached to the links. Each secondary guide member may be fitted with suitable bearings, preferably low friction bearings such as ball or roller races for engagement with the guide means.

The web gripping devices employed in the apparatus of the present invention may be of any type which can be made, for example, by cam means, to grip the edge of the web to be stretched at the beginning of the working run of an articulated chain, that is to say that part of the path of each chain wherein the chain is in engagement with the web through the gripping devices, and to release the edge of the web, for example, by cam means, at the end of the working run. Many types of such gripping devices are well known to persons familiar with the stretching of plastic webs and they may be mounted on any convenient part of, or attachment to, the articulated chain providing that when the chain is caused to expand the distance between adjacent gripping devices increases. The gripping devices are preferably attached to the carriages, desirably in such a position that the gripping area of each device is in such position relative to its carriage that the distance travelled by the mid part of the gripping area as the carriage enters or leaves a curve in the guide means is substantially the same as that travelled by the carriage. In this case, any acceleration or retardation of the said points in their direction of motion when the carriages enter or leave a convex or concave, curve respectively, or pass over a portion of the primary guide means of varying curvature, is limited. A further advantage is that the twisting moments applied to the carriages by the gripped web, especially during startup, are considerably reduced.

Clearly, in order for an articulated chain to expand, or unfold, within its working run, it must first be folded and if the maximum expansion is to be obtained from the chain, it should be folded as far as is practicable before expansion. The full expansion of the chain need not be utilized in the stretching of a web longitudinally since the degree of stretch utilized may be varied in other ways, for example, by varying the length of the working run of the chains such that the web is released before expansion of the chain is complete. Although the zigzag folding of the articulated chain may be achieved in random fashion, it is preferably achieved in a controlled and progressive manner to maintain smooth progression of the chain towards the beginning of the working run. Accordingly, it is preferred that the secondary guide members are positively located directly or indirectly in or on secondary guide means, to control the folding of the articulated chain and that at any point, to restrict the movement of the primary and secondary guide members in a direction substantially at right angles to the path of the chain and in a plane parallel to the plane of folding of the chain.

It will be appreciated, of course, that once an initial fold is made between successive links of an articulated chain being subjected to compressive forces, the chain will continue to fold providing it meets with some resistance to motion in the direction of the applied forces. It is therfore not essential to provide a secondary guide means along the section of the apparatus in which the articulated chain is being folded prior to the commencement of the working run. It is, however, preferred to have secondary guide means in this section.

The controlled folding of an articulated chain may be achieved in one or more steps and to simplify the engineering of the primary and secondary guide means necessary to fold the chain progressively in a controlled manner around a curve, the chain may be partially folded in a controlled progressive manner before reaching said curve, guided around the curve in a stable state of fold and then folded completely in controlled progressive manner. However, the whole action of folding the chains may be carried out prior to or after a curve or, indeed, may be progressively carried out prior to, during and after passage of the chain around a curve. The passage of a part-folded articulated chain in controlled manner along any path, but particularly a curved path, by the application of a compressive force must be controlled with care to reduce to a minimum the risk of a toggle action affecting the smooth running of the chain. The secondary guide means employed in co-operation with the primary guide means to control the progressive folding of the articulated chain may be in one or more sections which may form a continuous secondary guide means for the folding section of the chain.

Any means may be provided for initiating the folding of an articulated chain between successive links, but preferably the engagement end of the secondary guiding means for the secondary guide members in the region of the lead-in sprocket of the preferred apparatus is located at such a position as to engage the secondary guide members at least indirectly, as they begin to leave the sprocket.

The secondary guide means for the folding section of an articulated chain is preferably disengaged at, before, or just after, the beginning of the working run. The articulated chain at the beginning of the working run is preferably in the fully folded state, that is to say the chain will fold no more, for example, because attachments thereto come into abutting relationship. Thus, the folded state of the chain remains stable without the controlling influence of a secondary guide means. At the point where commencement of controlled expansion of the articulated chain is desired, the secondary guide members then re-engage the secondary guide means, which, in co-operation with the primary guide means, is arranged to control the expansion of the chain, for example, as it is pulled by the lead-out sprocket of the preferred apparatus. The expansion of the articulated chain is preferably controlled until it is fully expanded, at which time the secondary guide means is disengaged. In the preferred apparatus, the articulated chain in the fully expanded state then travels around the lead-out sprocket and is then conveyed in substantially the same condition back to the lead-in sprocket without the secondary guide members re-engaging the secondary guide means, although they may engage with the primary guide means. However, as previously stated, it is often desirable to have at least one pair of links at least partially folded in the return run to accommodate cumulative tolerances and wear, and spare links.

It will be appreciated that at regions in the working run of the chain at which the primary and secondary guide means are each substantially straight sections and converging towards one another, the rate of expansion of the articulated chain will decrease in a non-linear fashion. This may be advantageous where, for example, it is desirable to reduce the rate of longitudinal stretch of a material as its temperature falls. It may, however, be desirable to stretch a material longitudinally at a substantially uniform rate throughout. For this purpose, the secondary guide means may be suitably curved in relation to the primary guide means to achieve a substantially uniform rate of expansion of the articulated chain for part or the whole of its controlled expansion. Such a curve for a secondary guide means in co-operation with a straight primary guide means may be derived by employing the following formula:

$$R = R\ \max\ (1-(W/e)^2)^{\frac{1}{2}}$$

where:

R = longitudinal stretch ratio at any point considered along the primary guide means;

e = distance between the centers of the pivotal connections of each link;

w = perpendicular distance measured between a line joining the centers of the non-common pivotal connections of two consecutive links and associated with consecutive carriages, respectively, and the center of the common pivotal connection of said two links; and R max = desired final longitudinal stretch-ratio imparted to web of material at point when the chain is fully-expanded.

It will be appreciated that when the properties of a material are such that it is desirable to change the temperature progressively during stretching, it is desirable that the same stretching rate occurs in both longitudinal and transverse directions at all stages of the stretch, as otherwise, differences between longitudinal and transverse shrinkage may arise on heating the final product to a given temperature.

The apparatus of this invention, in use, may have the web drawn or assisted through it by known means such as a pair of driven nip rollers, which together with the web feed may be synchronized respectively with the output and input speeds of the stretching apparatus.

The working runs of the articulated chains may be straight or curved or a combination of straight and curved portions. Corresponding portions of the working runs may be set parallel or at an angle to one another, diverging or converging in the direction of travel of the web. Thus, the apparatus of this invention may be used not only for longitudinal stretching but for transverse stretching or retraction. In cases where it is not necessary or desired that a uniform rate of stretch or retraction transverse to the sheet be applied, it is possible that the divergent or convergent portions of the working runs are curved. If the secondary guide means are arranged so that the articulated chains do not expand over the working run, the apparatus may be used for transverse stretching without longitudinal stretching. Longitudinal and/or transverse stretching may be arranged over the whole or only part of the working runs and in various ways as described in British Specification No. 936,965. It is sometimes preferable for the longitudinal and transverse stretching to occur at the same time and clearly this may be achieved by arranging for at least parts of the working runs to diverge and for the primary and secondary guide means controlling the expansion of the articulated chain in said parts to converge.

If it is desired to be able to adjust the longitudinal and/or transverse stretch ratios, particularly while the apparatus of the invention is in operation, it may be adapted for this facility in the general manner described in British Specification No. 1,091,971. It will be evident from this prior specification that, to accommodate an adjustment of the transverse stretch ratio by altering the degree of divergence of opposing stretching sections of the working runs as distinct from merely altering the degree of divergence of, or the lateral separation of, the complete working runs, a degree of flexibility in the primary guide means is a pre-requisite. Such flexibility may be achieved by introducing hinged joints or flexible portions into the primary guide means. Such flexible portions may be, for example, constructed of laminar steel or flexible wear resistant plastic material. Alternatively, a part of the guide means may be machined out to reduce its cross-section and increase its flexibility or indeed the primary guide means may be inherently sufficiently flexible to accommodate adjustment. When a guide means is continuous, some means may be necessary to accommodate any change in the effective length of the forward run relative to the return run. Telescopic guide means, for example, may be used.

It will be seen further that adjustability of the longitudinal stretch ratio may be provided by arranging for the secondary guide means to be adjustable relative to the primary guide means, particularly the angle between them, on each side of the apparatus in the stretching section, the arrangement being such that the degree of folding of the chain is altered immediately prior to, and/or after the stretching section. A change in the longitudinal stretch ratio may clearly result in a change in the amount of the chain in the forward run. When the primary guide means is continuous, as in the preferred apparatus of this invention, the expedients described in British Specification No. 1,091,971 for accommodating such a change cannot be readily employed. It will be appreciated, however, that in such cases folded chain may be accommodated in the return run to form a bank of links which may be added to or drawn upon, on changing the stretch regime, for example, by transiently altering the relative driving speed at one end relative to that at the other end of the apparatus. Such a bank of links may also be employed to accommodate changes in the amount of chain in the forward runs caused by a change in transverse stretch ratio.

In one embodiment of this invention in which the provision of alternative stretch ratios is a feature, the out-going width for the stretched sheet is kept constant and the in-going width may be altered. In this embodiment, which incorporates substantially parallel primary guide means in the sections of the working run prior to and after the stretch, the longitudinal stretch ratio adjustment is achieved by altering the relative parallel position of the secondary guide means to the primary guide means in the section after the stretch section and the angle between the primary and secondary guide means in the stretch section on each side of the machine. The transverse stretch ratio adjustment is achieved by altering the angle between the section of the primary guide means prior to the stretch section and the angle between the section of the primary guide means after the stretch section, respectively, and the intermediate stretching section of the primary guide means. This may be achieved by parting the primary guide means at the beginning of the section of the apparatus prior to the stretch and moving the section of the primary guide means after the stretch, parallel to itself in the appropriate direction allowing the primary guide means to bend at both ends of the stretching section. With the section of the primary guide means prior to the stretch in the new position, the primary guide means is then re-joined employing an adaptor piece or substitute adaptor piece. It will be evident that, on parting the primary guide means, the chain will also be required to be parted and this being done, any change in the amount of chain in the forward run arising from the adjustment of the transverse or indeed the longitudinal stretch ratio can be accommodated by removing or inserting links and carriages. Because of the general interest in keeping down the friction and drag in the system when adjustment necessitates parting the chains, it is preferred, especially for large decreases in the amount of chain in the forward run, to remove the links and carriages completely rather than introduce them in folded fashion into the return run.

Adjustment of the longitudinal stretch ratio may, of course, be effected by simply altering the lengths of the chain links. This is, for example, possible if means are provided for changing the position of the pivot points of the links. This expedient may also be employed to extend the range of adjustability which may be provided by other means such as an arrangement for varying the relative positions of the primary and secondary guide means as described above.

It will be appreciated that providing for the adjustment of the longitudinal and/or transverse stretch ratios will often necessarily include a provision for adjustment of the drive means and/or modification of the drive means, for example, changing from sprocket drive to auxiliary toothed chain drive.

DESCRIPTION OF THE APPARATUS SHOWN IN THE DRAWINGS

Referring to the drawings, the apparatus comprises an endless articulated chain consisting of a plurality of links 1 which passes round a lead-in sprocket 2 and a lead-out sprocket 3. Each link is pivotally connected to adjacent links at points 4 and 5 by members 6 and 7 respectively which at each end project beyond the links through plain bearings. Of course ball or roller bearings, for example could be provided alternatively. Each member 6 is also the axle for a wheel 14 of a wheeled carriage 8 which bears a gripping device for the web to be stretched. Each carriage 8 which is of substantially C-shaped cross-section rides on primary guide means in the form of continuous rail 10 through wheels 14 and 22*a*, 22*b* and 22*c*. The rail 10 mounted via brackets onto suitable frame-work is machined to have surfaces 33, 34, 35 on which the wheels of the carriage may run. The surfaces 34 and 35 are each at an angle of 45° to surface 33. This arrangement is such that rotation of carriage 8 about three mutually perpendicular axes is restricted. The four wheels 14, 22*a*, 22*b* and 22*c* respectively can rotate freely about members 6, 36, 37 and 38. The wheels may have any suitable low friction bearing such as plain, ball or roller bearing but advantageously the wheels are ball races having a frictional co-efficient of 0.001 to 0.003. Although for convenience, carriage 8 is shown as having four wheels 14, 22*a*, 22*b* and 22*c*, it is preferred that wheels 22*a* and 22*c* should each be replaced by a pair of spaced apart wheels of similar orientation to wheels 22*a* and 22*c*.

Members 7 are guided intermittently by secondary guide means 12 formed of discontinuous guide members which they engage through bearing 11. Sprockets 2 and 3 have teeth 13 which can positvely engage members 7 through bearings 19, to drive the articulated chain. Conventional sprocket teeth are however preferred which are profiled to engage the bearings at substantially more than point contact and to release the bearings smoothly as the drive is removed therefrom.

Figure 2:
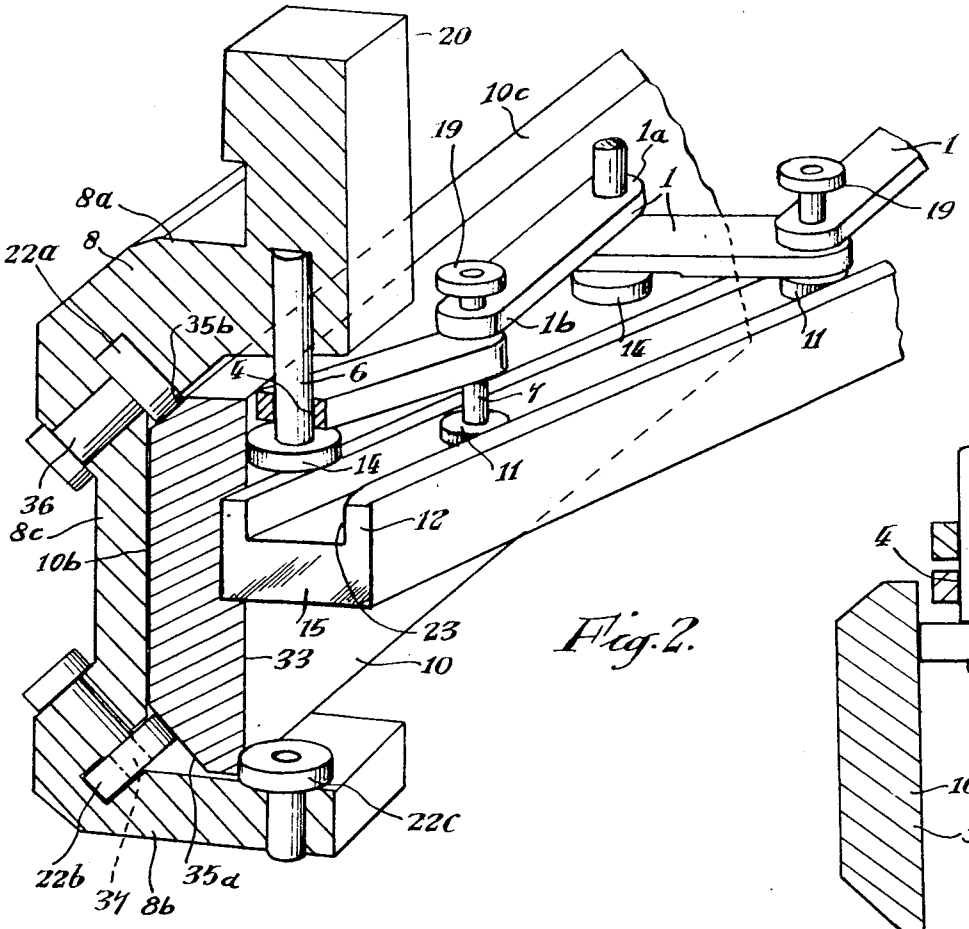
FIG. 2 shows a perspective view of a part-section along the line I—I in FIG. 1.

As can be understood from FIG. 2, sprocket 2 (not shown) engages guide members 7 via bearing 19 and drives them into the secondary guide means 12 which has the form of a channel-shaped track. The engagement end 15 of secondary guide means 12 is shown to have a slight bell-mouth 23 to assist location of bearing 11. The pedestal 20 of carriage 8 carries a gripping device (not shown in FIG. 2).

Figure 4:
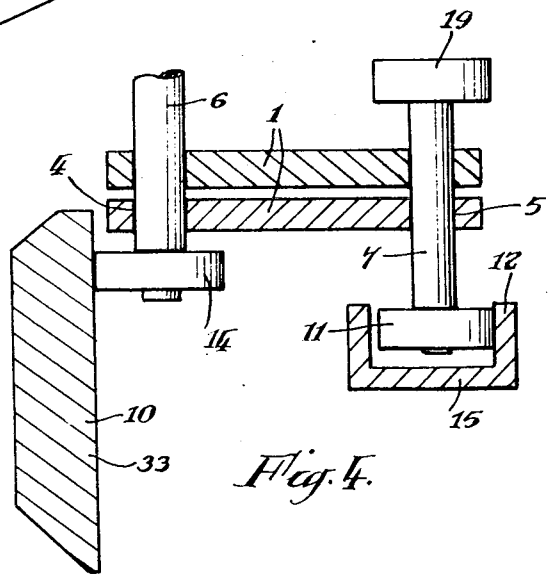
FIG. 4 shows a cross-sectional view along the line III—III in FIG. 3.
Figures 3, 5:
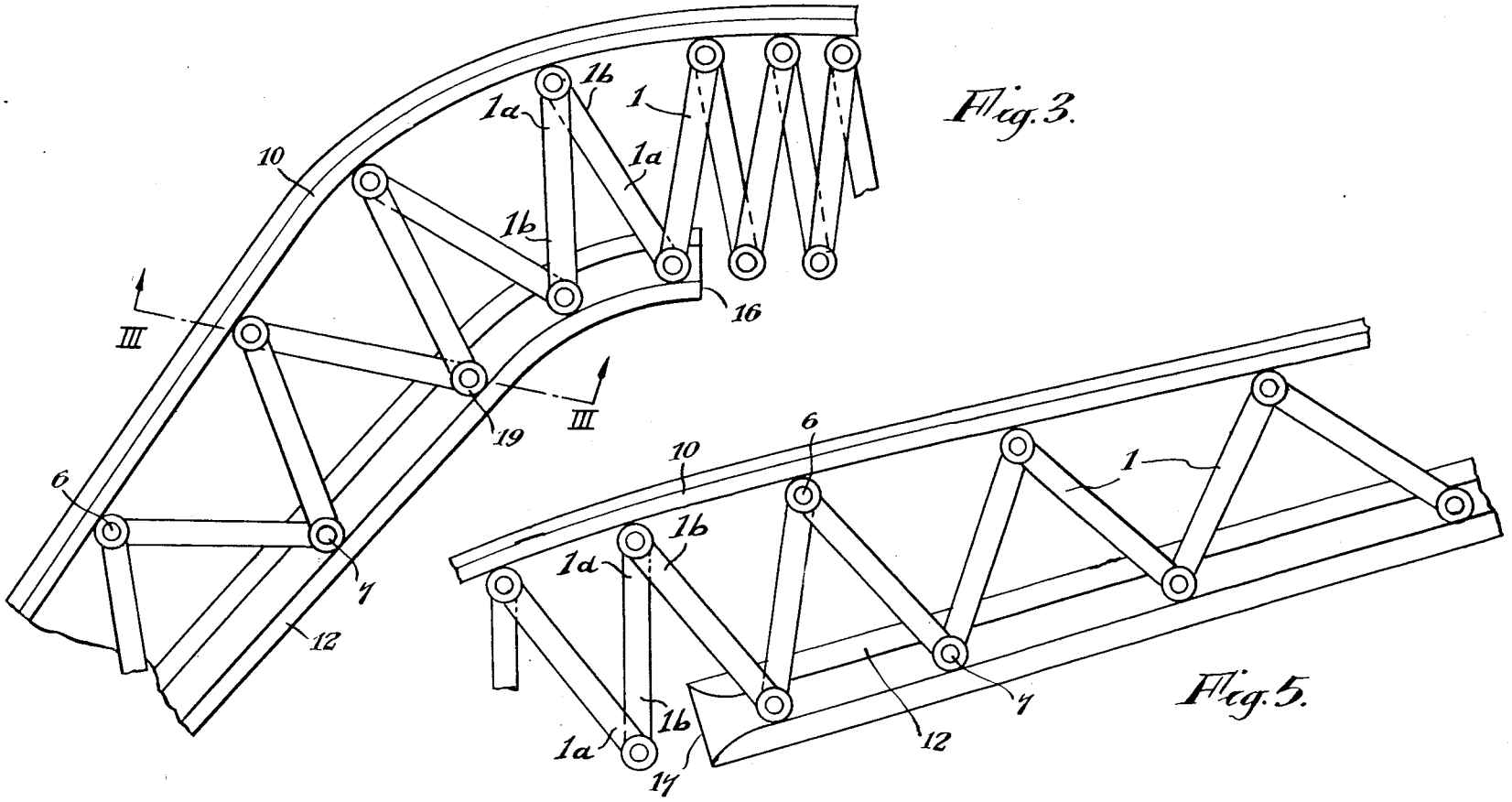
FIG. 3 shows an enlarged plan view of a part of the apparatus enclosed by Box II in FIG. 1.
FIG. 5 shows an enlarged plan view of a part of the apparatus enclosed by Box IV in FIG. 1.

FIGS. 3 and 4 show the arrangements of primary and secondary guide means, 10 and 12 respectively which cause the articulated chain to fold progressively in response to a compressive force applied in the generally intended direction of motion of the chain, in controlled manner prior to and during passage of the chain around a curve. It is preferred however, that the folding is completed before the curve is reached thus enabling the secondary guide means to be straight and also to be terminated before the curve. On completion of the folding of the chain at which point the carriages abutt against one another via spacing projections thereon, (not shown), the secondary guide means 12 is terminated at 16.

FIG. 4 shows a detail of the relative disposition of the members 6 and 7, wheel 14 and bearings 11, 19 and primary and secondary guide means 10 and 12 respectively during folding of the articulated chain.

FIG. 5 shows the re-engagement of the secondary guide means 12 formed of discontinuous guide member by the secondary guide member 7 through bearings 11 (not shown) at the commencement of the expansion of the fully folded articulated chain. Bell-mouth 17 assists the engagement of bearings 11 at the entrance end of an expansion-control section of the secondary guide means 12.

Figure 6:
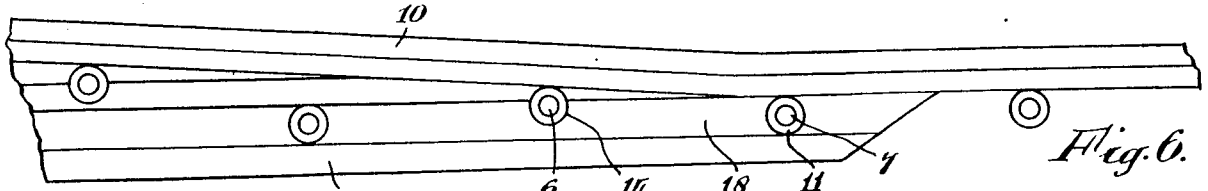
FIG. 6 shows an enlarged plan view of a part of the apparatus enclosed by Box V in FIG. 1.

FIG. 6 shows the arrangement signified generally by 18 in FIG. 1 whereby, when the controlled expansion of the chain is complete, the secondary guide means is disengaged in smooth manner.

Figure 7:
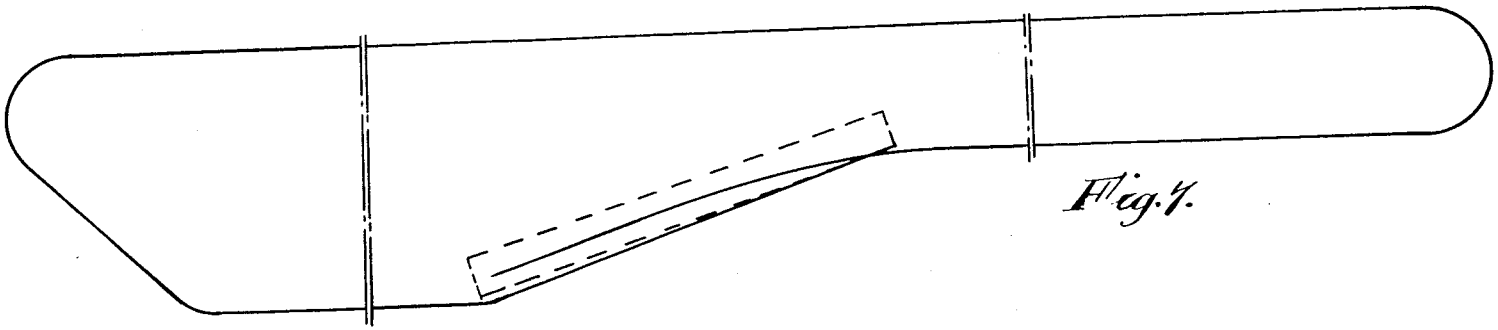
FIG. 7 shows in a general way, a modification to the apparatus shown in FIG. 1.
Figure 8:
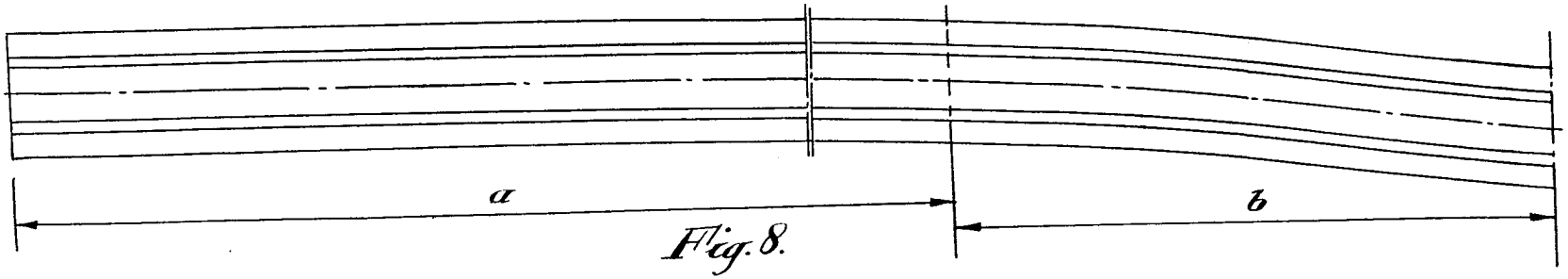
FIG. 8 is an enlarged plan view of the part of the apparatus enclosed by Box VI in FIG. 7.

FIG. 7 illustrates in simplified form how the secondary guide means 12 formed of discontinuous guide members may be curved with respect to the straight primary guiding means 10 in order to achieve a substantially uniform rate of stretch over substantially the whole length of a portion of the apparatus in which the primary guide means on the two sides of the apparatus diverge. The curved portion of the secondary guide means 12 is shown in more detail in FIG. 8. To facilitate a smooth transition of the bearings 11 from the secondary guide means 12 to the primary guiding means 10 when the articulated chain is substantially fully expanded, it may be desirable to apply the formula given hereinbefore over the initial part (a) of the secondary guide means 12, for example the initial two-thirds, the curve for the remainder (b) of the section of secondary guide means 12 being derived empirically. By way of illustration, where the length of the secondary guide means 12 was 65 inches, the ultimately required longitudinal stretch ratio was 4:1 and the distance between pivotal connections on each link was 3 inches, the above-given formula was applied to derive the curvature of the initial 40.5 inches of the guide means 12. The curvature of the remaining 24.5 inches was derived by trial and error to achieve an optimum smoothness of transition to the fully-expanded state of the chain.

Figure 9:
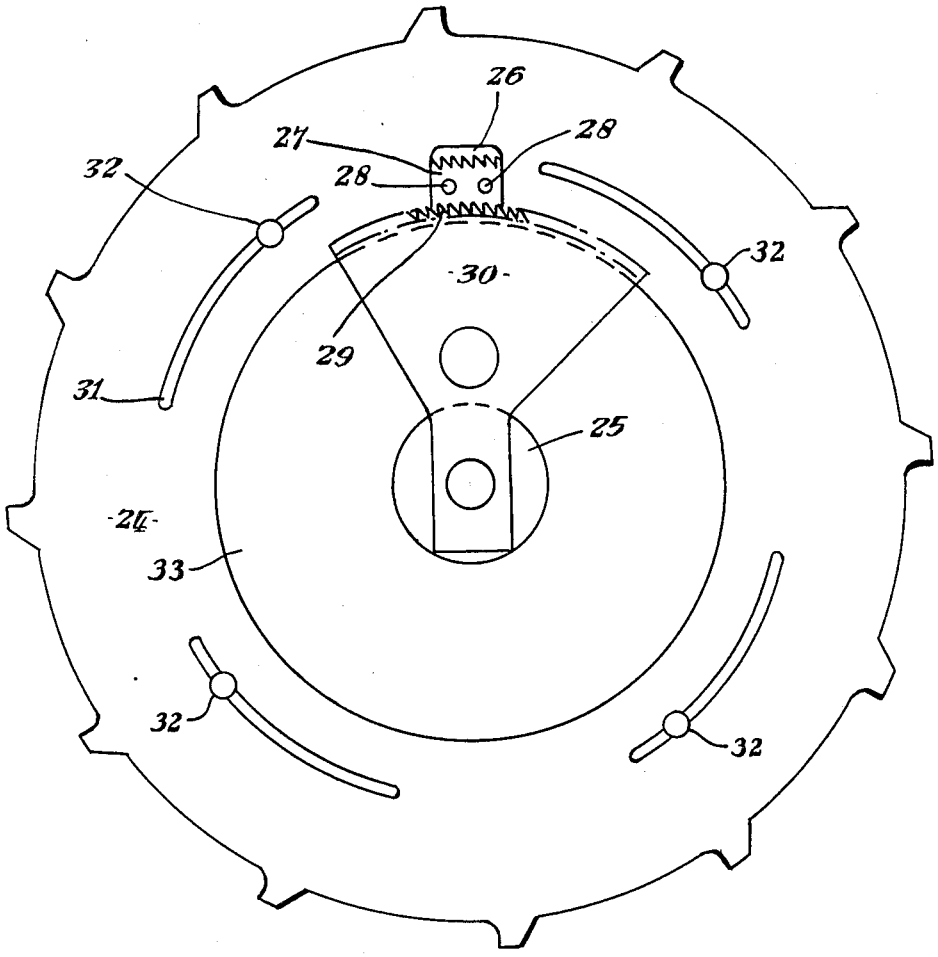
FIG. 9 shows one form of adjustable sprocket for use in the appartus.

FIG. 9 illustrates a preferred design for an adjustable sprocket comprising peripheral toothed portion 24 and a central boss 33 which includes the drive-shaft 25. A recess 26 in the toothed portion 24 accommodates a toothed locking key 27 which may be secured to the boss 33 by bolts 28. Locking key 27 bears two sets of teeth each set being offset with respect to the other by a distance p where p is the pitch of the teeth, and is reversible so that either set of teeth may engage with corresponding teeth 29 on vernier plate 30 secured to the drive-shaft. Peripheral toothed portion 24 bears arcuate slots 31 and may be secured to the boss 33 by bolts 32. When adjustment is required, locking key 27 is removed from recess 26 by first removing bolts 28 and lifting the key clear of the recess 26 and teeth 29. The peripheral toothed portion 24 is then released by loosening bolts 32 whereupon the toothed portion 24 may be rotated relatively to the drive shaft. When the desired position of the peripheral toothed portion 24 has been found the locking key 27 is inserted in the recess 26 with the most favourably disposed set of teeth in engagement with teeth 29. The key is secured with bolts 28 and then bolts 32 are tightened to complete the operation.

Figure 10:
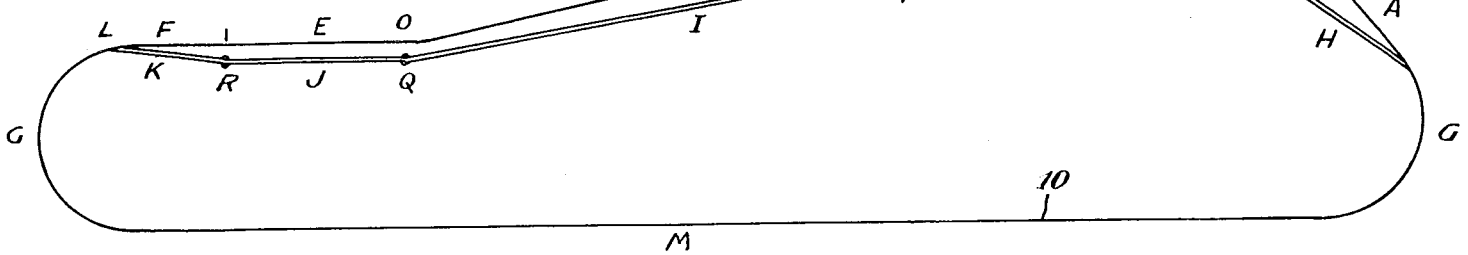
FIG. 10 shows an arrangement for the primary and secondary guide means of one form of an adjustable ratio apparatus.

FIG. 10 illustrates one form of apparatus in which the longitudinal and/or transverse stretch ratios may be adjusted, for simplicity, only the primary and secondary guide means are shown. The primary guide means is shown as a continuous rail 10 which is advantageously of the form shown in FIG. 2 comprising chain-folding and in-going sections A and B, preheat section C, stretch section D, annealing and/or cooling section E at the end of which the stretched web would normally be released, chain-unfolding section F, arcuate end sections G, and return section M. The secondary guide means, preferably of the form shown in FIG. 2 has a chain folding section H, a stretch section I, a section J parallel to E and unfolding section K. The primary guide means is adapted to bend about points N and O. Section B of the primary guide means is removable and the positions of sections C and D are adjustable, for example, on slides movable relative to a base member by the operation of lead screws, the slides being such as to allow the primary guide means to move longitudinally of the apparatus as necessary when adjusting the transverse dispositions of C and D. The secondary guide means H is in fixed relation to A, for a given link length, and positioned such that the chain is completely folded as it leaves its free end. Hinge point P for I is in fixed relation to N for a given line length. J, which is hingedly connected at Q to I and to K at R, is movable relative to E in parallel fashion via for example lead screws and slides, which may also allow longitudinal positioning, and the out-going end of K may be arranged to be in sliding contact with the primary guide means at L where the primary and secondary guide means merge into one another. Hinge joints Q and R may be movable such as to allow J and K to move longitudinally of the apparatus as I moves about hinge point P. To adjust the transverse stretch ratio (while keeping the out-going width of the stretched product to be produced constant) the articulated chain is parted in the region of the junction between A and B, the chain is then removed from section B by pulling the chain carried by carriages of the preferred form down the stretch section and around into the return run M where the excess links may be freely folded. Section B of the primary guide means is then removed. The sections C and D are then unclamped and adjusted by means of lead screws operating travellers on which the sections can also move longitudinally of the apparatus. In adjusting sections C and D, bending of the rail occurs about points N and O. When the new position for sections C and D have been reached, the sections are clamped. A replacement rail section (not shown) is then inserted in place of the original B section to connect rail sections A and C. The chain is then pulled out of the return run if necessary after some links and carriages have been added or removed to fill the replacement rail section and the chain reconnected. Because hinge point P is fixed with respect to N, and in this context Q with respect to O, it will be appreciated that the longitudinal stretch ratio remains unaltered. To adjust the longitudinal stretch ratio, sections of the secondary guide means I, J, K and hinge joints Q and R are unclamped and the relative position of section J parallel to E, adjusted. Adjustment of J alters the angle of I with respect to D, the degree of folding at the end of the stretch section, and therefore the ratio of longitudinal stretch achieved therein. Adjustment of J in parallel manner, for example by means of co-operating lead screws, must of course result in some longitudinal movement of the section itself as described, and/or in movement within the joint Q, for which additional or indeed alternative provision can be readily made, for example, by providing sliding surfaces. Likewise, hinge joint R may be longitudinally extendable or retractable and/or the position at which K converges to F at L moveable. For example K may be merely in sliding sprung contact with F at L. On completion of repositioning the secondary guide means, the sections are preferably re-clamped. It will be appreciated that, in making any adjustment by the means described, either to the longitudinal or transverse stretch ratios, the amount of chain in the forward run will be altered. Thus, it must be appreciated that either links will be required to be added or removed from the system or, as is preferred, for convenience, use must be made of a bank of folded links, maintained in the return run.

In the arrangement shown, the chain is fully extended for passage around arcuate sections G, when sprocket drive is provided over these sections. When the apparatus is run with the chain in the folded condition in the return run M, cams will be provided to initiate folding of the chain as it enters the return run and to unfold the chain before, or as, it leaves the return run. It will be further appreciated that the ratio of link length-/minimum-folded-width limits the maximum longitudinal stretch ratio for a given link and extension of the range of adjustment will require a change of link length. This may be effected by complete replacement or by employing for example, telescopically adjustable links.

Operation of the apparatus shown in FIGS. 1 to 10 is as follows. The articulated chain formed of links 1 is driven around the path defined by rail 10 by sprockets 2 and 3, the teeth of which engage members 7 through bearings 19. Members 6 mounted on carriages 8 running on rail 10 guide one end of each link along the path defined by rail 10. When the articulated chain is in the fully expanded state (including its passage around sprockets 2 and 3) guide members 7 follow members 6 and are steadied by bearings 11 engaging the inside surface of rail 10. At a point where the path of the chain is substantially tangential to lead-in sprocket 2 on its exit side, guide members 7 through bearings 11 engage secondary guide means 12 thus causing the articulated chain to fold, the angle between the rail 10 and secondary guide means 12 at any point being such as to cause the articulated chain to continue to fold progressively as it travels along the path between the lead-in sprocket and the point where the chain is folded to the extent that adjacent carriages 8 abut one another, preferably via spacing projections thereon. At this point shown as 16, but which is preferably situated at or before the curve, the secondary guide means is disengaged. The gripping devices 9 mounted on carriages 8 are then brought into operation (by means not shown) at a point beyond the curve to grip the edge of the web to be stretched and the web while being brought to a condition suitable for stretching is carried along by the chain to point 17 where secondary guide means 12 is re-engaged by bearings 11. The angle between the rail 10 and the re-engaged section of the secondary guide means 12 is arranged such as to control the rate of expansion of the articulated chain as it is pulled along its path by sprocket 3. As the articulated chain expands, the distance between the carriages 8 increases thus causing the web to be stretched in the longitudinal direction. At the end of the stretching operation, and when the chain is substantially fully expanded, secondary guide means 12 is again disengaged at point 18. The gripping devices are then caused to release the web (by means not shown) which is drawn off by separate apparatus. The fully expanded articulated chain then passes round sprocket 3 and follows the path defined by rail 10 back to and around sprocket 2 to complete one cycle of operation. It is normally arranged that there is some delay in releasing the web at the end of the stretching operation and that the web is held in the stretched condition for a cooling and/or an annealing treatment after which it is released. If the chains are not fully extended at the end of the stretching section, such as may be the case in the apparatus of FIG. 10, the web will normally continue to be gripped, in the cooling and/or annealing zone while the chain is maintained at a stable degree of fold and will be released after cooling and/or annealing before the chain is arranged to complete its extension at the out-going end of the apparatus.

In essence, the apparatus shown in the drawings for biaxially stretching a web of material continuously includes a pair of continuous primary rails 10 each having an inner longitudinal surface 33, an outer longitudinal surface 10*b*, an upper edge 10*c* and lower edge 10*d*. Adjacent the upper and lower edges to 10*c* and 10*d* are bevelled surface 35*a* and 35*b*. As is seen in FIGS. 10 and 1, the rails 10 define a pair of opposed continuous tracks (only one of which is shown) which tracks are mirror images of one another. As is seen specifically in FIG. 10, the tracks have upstream converging portions A, upstream parallel portions C, diverging portions D and downstream parallel portions E. The discontinuous guide members 5 are laterally positioned with respect to and coextensive with the primary rails 10 over at least the upstream converging portions A and the diverging portions D of the tracks defined by the primary rails.

The lead-in sprocket 2 and lead-out sprocket 3 have peripheral teeth 13 thereon which engage the continuous articulated chain formed of the plurality of links 1, which chain entrained around the sprockets. As is seen in FIGS. 2, 3 and 5, the links 1 have leading ends 1*a* and trailing ends 1*b* which are pivoted on axles 6 and 7 that extend both below and above the links 1.

First rollers 14 are mounted on the axle 6 and second rollers 11 are mounted on axle 7 with both rollers being positioned below the links 1 for engaging the primary rails 10 and guide members 15, respectively, in alternating fashion. The first rollers 14 are disposed above the second rollers 11 and engage the inner longitudinal surface 33 of the rails 10 continuously. The second rollers 11 are disposed below the first rollers 14 and engage the guide members 15.

Third rollers 19 are mounted on the axle 7 having the second rollers 11 thereon. The third rollers 19 are positioned above the links 1 and are in planar alignment with the teeth 13 of the sprockets 2 and 3, which teeth engage the rollers to drive the chain formed of the connecting links 1.

A plurality of carriages 8 are mounted on the primary rails 10. Each carriage 8 is generally C-shaped in configuration with upper legs 8*a* and lower legs 8*b* joined by a bight 8*c*. The upper and lower legs 8*a* and 8*b* overlie and extend beyond the upper and lower edges 10*c* and 10*d*, respectively, of the rails 10 and the bight 8*c* extends over the outer longitudinal surface 10*b* of the rail. Each of the carriages 8 includes a pedestal 20 for mounting a gripping means (not shown) for gripping the film at a position in vertical alignment with the rails 10 upon which the carriages are mounted.

The carriages themselves are mounted on the axles 6 which have the first rollers 14 thereon. On each of the carriages there are roller means 22*a*, 22*b* and 22*c* for engaging the rail 10 at the bevelled upper portion 35*a* of the outer longitudinal surface adjacent the upper edge 10*c* of the rail, bevelled lower portion 35*a* and the inner surface 33. Consequently, each carriage 8 is stably mounted on one of the rails with spacing between each carriage and the adjacent carriage determined by the angle between the links 1.

What we claim is:

1. Apparatus for biaxially stretching a thin continuous web of material continuously, the apparatus comprising:

(a) a pair of continuous primary rails each having an inner longitudinal surface, an outer longitudinal surface with bevelled upper and lower portions, and upper and lower edges; the rails defining a pair of opposed tracks which are mirror images of one another, the tracks having upstream converging portions, upstream parallel portions, diverging portions and downstream parallel portions;

(b) secondary guide means formed of discontinuous guide members laterally positioned with respect to and coextensive with the primary rails over at least the upstream converging portions and the diverging portions of the tracks defined by the primary rails;

(c) lead-in and lead-out sprockets having peripheral teeth thereon;

(d) a continuous, articulated chain formed of a plurality of links and entrained around the sprockets, the links having leading and trailing ends which are pivoted on parallel axles that extend both below and above the links;

(e) first and second rollers mounted on the axles below the links for engaging the primary rails and the discontinuous guide members in alternative fashion, with the first rollers being disposed above the second rollers and engaging the inner longitudinal surfaces of the rails continuously and the second rollers being disposed below the first rollers and engaging the discontinuous guide members;

(f) third rollers mounted on the axles having the second rollers thereon, the third rollers being positioned above the links and being in planar alignment with the teeth of the lead-out and lead-in drive sprockets for engagement by the drive sprockets to advance the chain;

(g) a plurality of carriages mounted on the primary rails, each carriage being generally C-shaped in configuration with upper and lower legs joined by a bight; the upper and lower legs overlying and extending beyond the upper and lower edges of the rails, respectively, and the bight extending over the outer longitudinal surfces of the rails; the carriages including a pedestal for mounting gripping means for gripping the web of material; the gripping means gripping the web of material at positions in vertical alignment with the rails upon which the carriages are mounted;

(h) means for mounting the carriages on the axles which have the first rollers thereon, and (i) roller means on each of the carriages for engaging the rail at the bevelled upper portion of the outer longitudinal surface adjacent to the upper edge of the rail; the bevelled lower portion of the outer longitudinal surface adjacent the lower edge, and at the inner surface of the rail wherein each carriage is stably mounted on one of the rails with spacing between each carriage and adjacent carriages determined by the angle between the links.

2. The apparatus of claim 1, wherein the bevelled surfaces are disposed at angles with the inner surface which are in the range of 10 to 80 degrees.

3. The apparatus of claim 2, wherein the bevelled surfaces are disposed at angles with the inner surface which are about 45 degrees.

4. The apparatus of claim 3, wherein the discontinuous guide members are disposed lower than the top edge of the primary rails.

5. The apparatus of claim 4, wherein the discontinuous guide members are channel-shaped in cross-section adjacent the diverging portion, with the pair of guide surfaces of the channel facing inwardly with respect to the channel shape, the second rollers being received between the guide surfaces.

* * * * *